United States Patent [19]

Enkner

[11] 3,980,285

[45] Sept. 14, 1976

[54] TILTABLE CONVERTER

[75] Inventor: Bernhard Enkner, Linz, Austria

[73] Assignee: Vereinigte Osterreichische Eisen- und Stahlwerke-Alpine Montan Aktiengesellschaft, Linz, Austria

[22] Filed: Apr. 23, 1975

[21] Appl. No.: 570,826

[30] Foreign Application Priority Data

Apr. 25, 1974 Austria ..... 3409/74

[52] U.S. Cl. ..... 266/246

[51] Int. Cl.[2] ..... C21C 5/42

[58] Field of Search ..... 266/35, 36 P, 36 H, 266/246

[56] References Cited

UNITED STATES PATENTS 3,561,744 2/1971 Altman ..... 266/36 P 3,635,458 1/1972 Puhringer ..... 266/36 P

*Primary Examiner*—Roy Lake
*Assistant Examiner*—Paul A. Bell
*Attorney, Agent, or Firm*—Brumbaugh, Graves, Donohue & Raymond

[57] ABSTRACT

A tiltable converter is borne by means of supporting elements, accommodating support and tilting forces, on a carrying ring provided with two carrying trunnions arranged opposite each other. Axially movable carrying disks engage in bearing eyes secured to the converter shell.

13 Claims, 9 Drawing Figures

TILTABLE CONVERTER

BACKGROUND OF THE INVENTION

The invention relates to a tiltable converter which is borne by means of supporting elements, accommodating support and tilting forces, on a carrying ring of preferably box-shaped profile. The carrying ring is provided with two carrying trunnions arranged opposite each other. Axially movable carrying disks assigned to the carrying trunnions engage in bearing eyes secured to the converter shell.

From Austrian Pat. No. 271,527 annular bearing eyes as supporting elements for a converter connected to the converter shell are known. Into these bearing eyes there project carrying disks connected with the carrying ring. In Austrian Pat. No. 293,456 there is described an embodiment of this carrying-disk-suspension for converter exchange vessels. These are converters that are not relined in the blowing stand of the steel works, but in a proper lining stand, so that in the blowing stand a converter ready for operation is constantly available. It is therefore important that converter exchange vessels should be capable of being easily mounted into and removed from the carrying ring surrounding them without careful adjustment work and complicated manipulations being necessary.

In the construction according to Austrian Pat. No. 293,456 relatively large recesses are provided in the carrying ring at that point of the carrying ring which is subject to the heaviest wear, i.e. where the support forces are being introduced, so that for removing the converter the carrying disks may be retracted from the bearing eyes secured to the converter shell into these recesses. The converter vessel may then be lowered in the vertical direction through the carrying ring and may be removed from the blowing stand using an appropriate lifting and transporting device. It is the essence of the carrying-disk suspension that the carrying disks which engage with play in the corresponding bearing eyes should be as large as possible and that the support surface should be as broad as possible. Another requirement that converter plants of this type have to meet consists in that the carrying ring which, as a rule, has a box-shaped profile, should be constructed as light as possible. Moreover, the profile of the carrying ring should be shaped as evenly as possible all around. Large recesses are therefore disadvantageous and require special constructional and productional measures that raise the production costs and increase the weight of the carrying ring. Finally, in the construction of the converter and the carrying ring, special attention has to be paid to the problem of assuring that as a consequence of a differential heating of the converter shell and the carrying ring during operation, or within one converter journey, these constructional elements are sufficiently movable in the radial direction, and that too large a distance between the carrying bearings of the converter or between its carrying trunnions is not required. The disk suspension solution is applicable only for hollow trunnions and in cases involving a potential supply of a cooling medium (e.g. in case of a water-cooled carrying ring) additional and complicated constructional measures are necessary.

SUMMARY OF THE INVENTION

The invention aims at avoiding the aforementioned disadvantages and it is its object to create in a carrying-disk-suspension a homogeneous construction of the carrying ring without providing large recesses for receiving the carrying disks. Inspite of the use of the smallest possible distance between the converter shell and the carrying ring, a path as large as possible to accommodate the radial shifting of the construction elements against each other, caused by the development of heat, is to be maintained.

According to the invention this object is achieved in that the carrying disks are releasably connectable by means of tongue-and-groove connections with that part of the carrying ring which is provided with the trunnion. For achieving the connection the converter together with its carrying disks is insertable from below into the carrying ring and when in the operating position the carrying disk is capable of being locked with the carrying ring by means of an adjusting device.

Suitably at the carrying disk and at the pertaining part of the carrying ring two upwardly tapering tongue-and-groove connections are provided and the converter, together with the carrying disks, is insertable from below as far as the stop caused by the conicity of the tongue-and-groove connections.

Preferably the adjusting device is an adjustable bolt penetrating a bore of the inner wall of the carrying ring and engageable and disengageable in relation to a conical seating of the carrying disk.

Moreover inclined guides acting upwardly are provided at the carrying ring. These guides, upon inserting the converter into the holding position, pull the carrying disks engaged in the guidings by means of pins into the engagement position of the tongue-and-groove connections.

Further advantages of the converter of the invention consist of simple and quick mounting, complete freedom from play after mounting, small cotter pin cylinders, and the possibility of dispensing with a torque control against distortion of the carrying disk in relation to the carrying ring. The invention may be applied to both hollow and solid trunnions.

BRIEF DESCRIPTION OF THE DRAWINGS

The carrying-disk suspension of the invention will now be described in more detail with reference to the accompanying drawings in which:

FIGS. 5 and 6 show a further embodiment of the carrying-disk-suspension using a hollow trunnion, the converter not being illustrated, wherein FIG. 5 shows a vertical section like FIG. 1, and FIG. 6 is a section similar to the one illustrated in FIG. 3.

DESCRIPTION OF EXEMPLARY EMBODIMENTS

Figure 1:
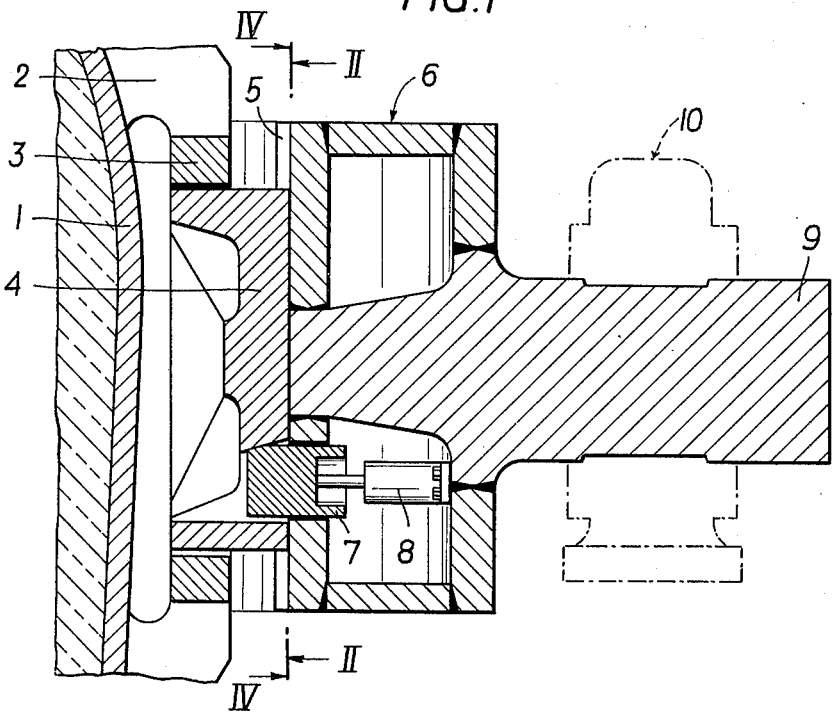
FIG. 1 shows a vertical section of the carrying-disk suspension of the converter.
Figure 2:
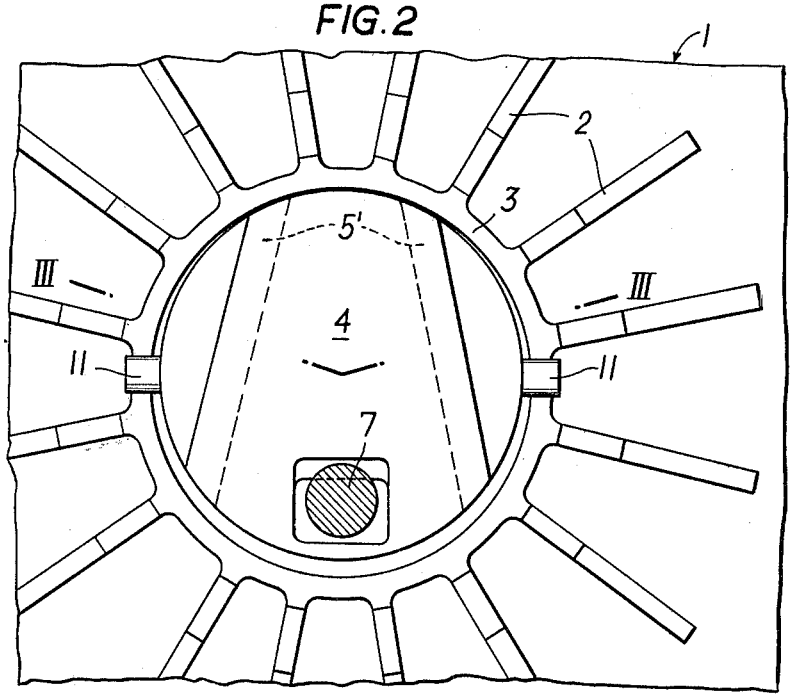
FIG. 2 is a section along line II—II of FIG. 1.
Figure 3:
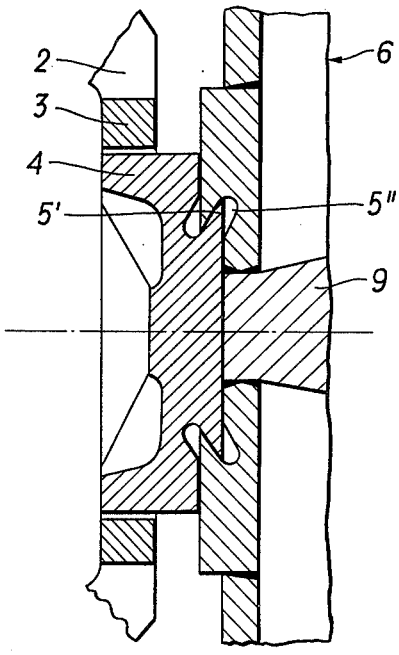
FIG. 3 is a section along line III—III of FIG. 2.

In FIGS. 1 and 2 the shell of a converter is denoted with 1. By means of ribs 2 a bearing eye 3 is secured to the shell and a carrying disk 4 engages the eye 3 with play. The carrying disk 4 and a carrying ring 6 are held together by a tongue-and-groove connection 5, wherein tooth-like projections 5′ of the carrying disk engage grooves 5″ of the carrying ring (FIG. 3). After the carrying disk 4 has been inserted from below into the wedge-shaped, i.e. conically tapering tongue-and-groove connection 5, it is held in position by a holding bolt 7 which is driven via a pressure cylinder 8.

The carrying ring 6 is penetrated by a carrying trunnion 9 which is borne in a bearing 10. At the carrying disk 4 two guiding pins 11 (FIG. 2) are provided which are positioned in guides 12 (FIG. 4).

FIG. 3 illustrates the tongue-and-groove connections 5 between the carrying disk 4 and the carrying ring 6. This connection has the form of an upwardly tapering wedge so that after mounting there is no play between the carrying disk 4 and the carrying ring 6.

Figure 4:
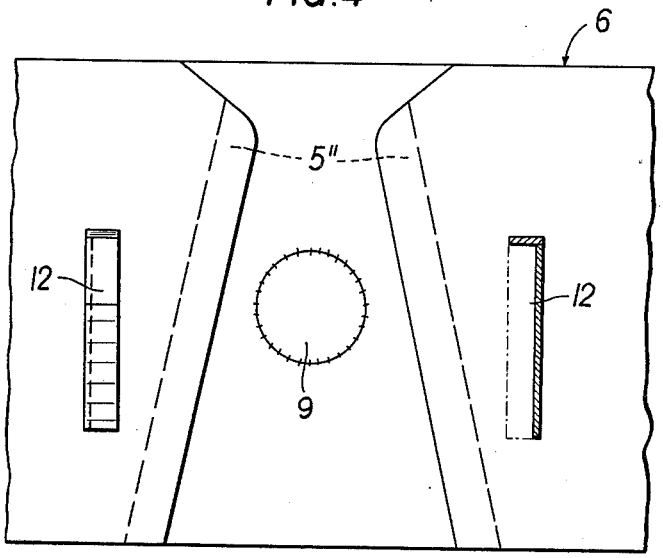
FIG. 4 illustrates a section along line IV—IV of FIG. 1.

FIG. 4 shows the carrying ring 6 with its grooves 5 and guides 12.

Figure 5:
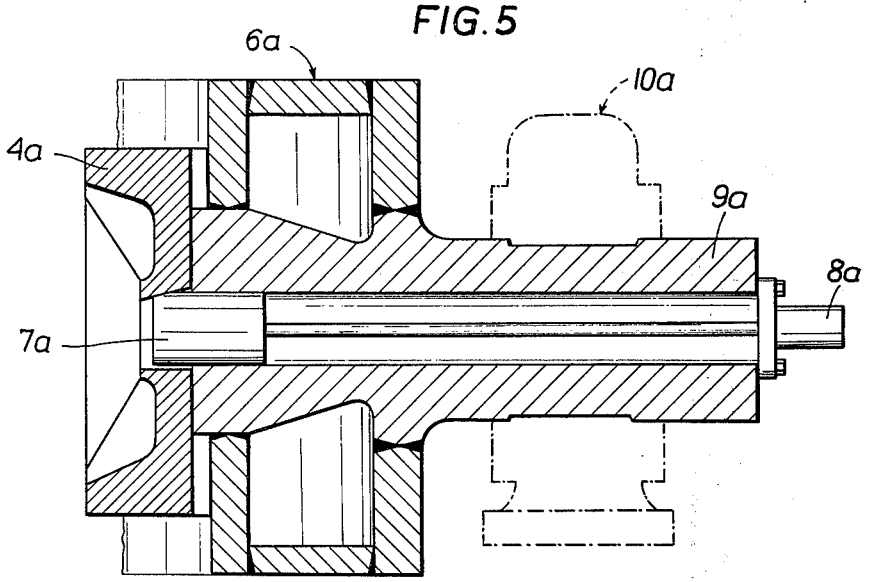

FIG. 5 illustrates a modified embodiment of the invention, wherein a hollow trunnion 9*a* is borne in the bearing 10*a*. Another difference as compared to FIG. 1 is in the tongue-and-groove connection, which in this case is not arranged between the carrying disk 4 and the carrying ring 6, but is immediately between the carrying disk 4*a* and the trunnion 9*a*. The holding bolt 7*a* together with its pressure drive cylinder 8*a* is arranged in a central bore of the trunnion 9*a*.

Figure 6:
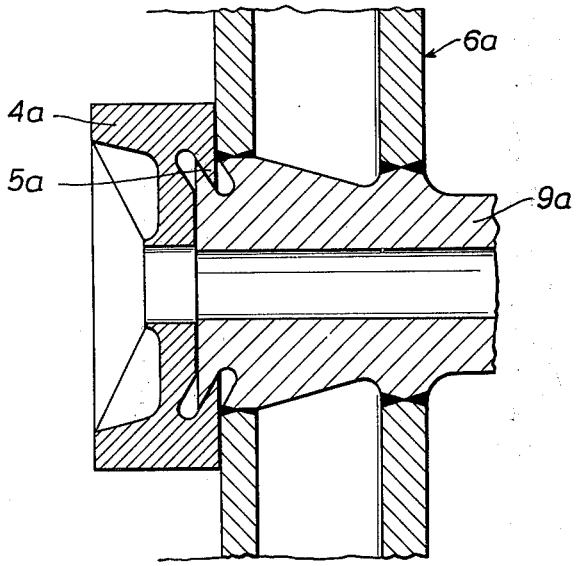

According to FIG. 6 the tongue-and-groove connection 5*a* is arranged in the form of the mirror image of the one according to FIG. 3.

Figure 7:
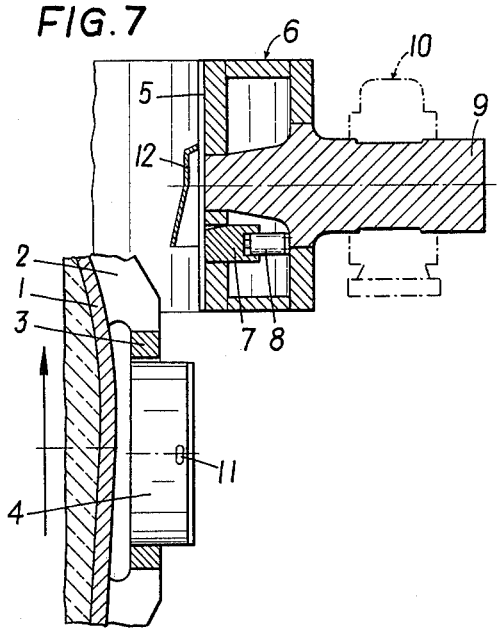
FIGS. 7, 8 and 9 show the mounting procedure in three different positions.
Figure 8:
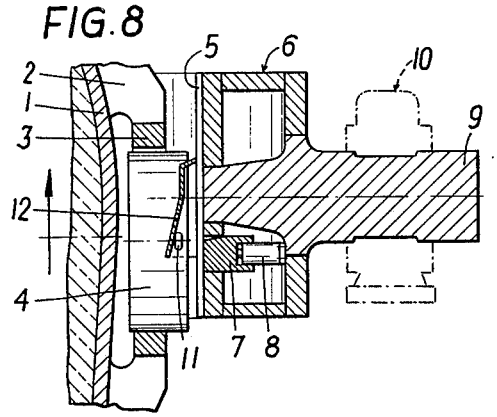
Figure 9:
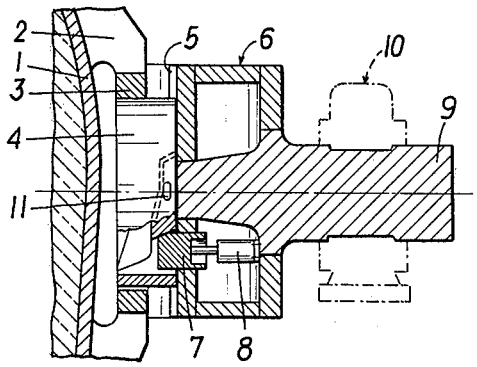

The mounting procedure for a converter according to the invention shown in FIG. 1 is illustrated in FIGS. 7 to 9 and is extremely simple. In FIG. 7 the converter 1 together with the carrying disk 4 retained in the bearing eye 3 move upward. In the position according to FIG. 8 the guiding pins 11 of the carrying disk 4 have already locked in the guides 12 of the carrying ring 6. Upon moving the converter further upward the carrying disk 4 is moved toward the carrying ring 6 until it sits close against the carrying ring. In FIG. 9 the tongue-and-groove connection has been accomplished and the holding bolt 7 is pressed into the carrying disk 4 by means of the pressure cylinder 8. Thus the play-free connection is achieved in the simplest possible way without adjusting work or complicated manipulations of the vessel being necessary. Since the area of contact at the holding bolt 7 determines via its inclination angle the force that the pressure cylinder 8 has to exert, this cylinder can be relatively small. In the same manner an automatic locking of the holding bolt 7 can be caused, depending upon the inclination angle and upon the coefficients of friction.

What I claim is:

1. A tiltable converter surrounded by a shell and borne on supporting elements accommodating support and tilting forces, said supporting elements comprising:

a carrying ring having a certain profile, two carrying trunnions provided on said carrying ring and arranged to lie opposite each other, two bearing eyes secured to the converter shell and arranged to lie opposite each other, and two carrying disks, each disk being engaged with play in a bearing eye, the carrying disks and the carrying ring being releasably connectable by means of tongue-and-groove connections in such a manner that the carrying disks each lie opposite corresponding carrying trunnions.

2. A tiltable converter as set forth in claim 1, wherein the carrying ring has a box-shaped profile.

3. A tiltable converter as set forth in claim 1, wherein the carrying trunnion is a solid carrying trunnion.

4. A tiltable converter as set forth in claim 1, wherein the carrying disks are axially movable.

5. A tiltable converter as set forth in claim 1, wherein for connecting the carrying ring and the carrying disks the converter together with its carrying disks is insertable from below into the carrying ring.

6. A tiltable converter as set forth in claim 1, wherein when the converter is in operating position the carrying disk is capable of being locked to the carrying ring by means of an adjusting device.

7. A tiltable converter as set forth in claim 6, wherein the adjusting device is an adjustable bolt penetrating a bore of the inner carrying trunnion wall and being engageable and disengageable in relation to a conical seating of the carrying disk.

8. A tiltable converter as set forth in claim 1, wherein at the carrying disk and at the carrying ring two upwardly tapering tongue-and-groove connections having a conical form are provided.

9. A tiltable converter as set forth in claim 8, wherein the converter together with the carrying disks is insertable from below as far as a stop caused by the conical form of the tongue-and-groove connections.

10. A tiltable converter as set forth in claim 1, wherein inclined, upwardlly acting guides are provided at the carrying ring and the carrying disks engage in the guides by means of pins.

11. A tiltable converter as set forth in claim 10, comprising a carrying ring and carrying disks being connectable with each other by means of tongue-and-groove connections, wherein upon inserting the converter into a holding position the guides pull the carrying disks into an engagement position with the tongue-and-groove-connections.

12. A tiltable converter as set forth in claim 1, wherein the carrying trunnion is a hollow carrying trunnion borne in a bearing.

13. A tiltable converter as set forth in claim 1, wherein the tongue-and-groove connection is arranged between the carrying disk and the carrying trunnion.

* * * * *